US009290880B2

(12) United States Patent
Park et al.

(10) Patent No.: US 9,290,880 B2
(45) Date of Patent: Mar. 22, 2016

(54) LAUNDRY TREATMENT MACHINE

(71) Applicant: LG ELECTRONICS INC., Seoul (KR)

(72) Inventors: Youngbae Park, Changwon-si (KR); Yongjun An, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/063,249

(22) Filed: Oct. 25, 2013

(65) Prior Publication Data

US 2014/0125210 A1 May 8, 2014

(30) Foreign Application Priority Data

Oct. 25, 2012 (KR) ..... 10-2012-0119175
Oct. 25, 2012 (KR) ..... 10-2012-0119176

(51) Int. Cl.
*D06F 37/18* (2006.01)
*D06F 39/14* (2006.01)

(52) U.S. Cl.
CPC ..... *D06F 37/18* (2013.01); *D06F 39/14* (2013.01)

(58) Field of Classification Search
CPC ..... Y10T 16/5387; Y10T 16/540255; D06F 39/14; D06F 37/10; D06F 37/18; D06F 23/04; E05Y 2900/312
USPC ..... 312/228, 327, 328; 16/303, 330, 296; 68/196; 49/239
See application file for complete search history.

(56) References Cited

U.S. PATENT DOCUMENTS 4,068,344 A * 1/1978 Okabe ..... 16/54
4,787,121 A * 11/1988 Racenis et al. ..... 16/356
5,109,571 A * 5/1992 Ohshima et al. ..... 16/307
5,356,000 A * 10/1994 Scicluna ..... 206/282
6,665,906 B2 * 12/2003 Li ..... 16/330
7,031,466 B2 * 4/2006 Lu et al. ..... 379/433.13
7,117,562 B2 * 10/2006 Zuo et al. ..... 16/303
7,155,776 B2 * 1/2007 Park ..... 16/50
7,173,825 B2 * 2/2007 Han et al. ..... 361/725
7,337,498 B2 * 3/2008 Hsieh ..... 16/330
7,418,279 B2 * 8/2008 Takagi ..... 455/575.1
7,818,845 B2 * 10/2010 Hu et al. ..... 16/330
8,336,167 B2 * 12/2012 Kim ..... 16/303
8,432,677 B2 * 4/2013 Duan et al. ..... 361/679.27
8,444,234 B2 * 5/2013 Kim et al. ..... 312/228

(Continued)

FOREIGN PATENT DOCUMENTS

CN 101988253 A 3/2011
CN 101988254 A 3/2011

(Continued)

*Primary Examiner* — Janet M Wilkens
*Assistant Examiner* — Hiwot Tefera
(74) *Attorney, Agent, or Firm* — Ked & Associates, LLP

(57) ABSTRACT

Provided is a laundry treatment machine which may include at least one hinge that supports a lid on a main body. The hinge may include a hinge housing, an elastic member disposed inside the hinge housing, and a pair of cams disposed in the housing to move in linkage with the lid and the elastic member. The cams may include contact surfaces that are inclined relative to each other in an axial direction of the cams, and when a contact surface of one of the cams slides along a contact surface of the other cam, a distance between the pair of cams may be changed to deform the elastic member. The contact surface of at least one of the cams may be divided into at least three sections by a prescribed angular range along the circumferential direction, each of the three sections having a separate contact surface.

19 Claims, 13 Drawing Sheets

(56) References Cited

U.S. PATENT DOCUMENTS

| | | | | |
|---|---|---|---|---|
| 8,763,431 | B2 * | 7/2014 | Kim et al. | 68/3 R |
| 2004/0202314 | A1 * | 10/2004 | Lu et al. | 379/433.01 |
| 2006/0063416 | A1 | 3/2006 | Takagi | |
| 2008/0128156 | A1 * | 6/2008 | Kuwajima et al. | 174/161 R |
| 2010/0162526 | A1 * | 7/2010 | Duan et al. | 16/303 |
| 2010/0275413 | A1 * | 11/2010 | Kim | 16/303 |
| 2011/0050059 | A1 * | 3/2011 | Kim et al. | 312/228 |
| 2011/0050060 | A1 * | 3/2011 | Kim et al. | 312/228 |
| 2011/0062837 | A1 * | 3/2011 | Kim et al. | 312/228 |
| 2011/0089793 | A1 * | 4/2011 | Kim et al. | 312/228 |
| 2012/0272481 | A1 * | 11/2012 | Ahn et al. | 16/325 |

FOREIGN PATENT DOCUMENTS

| | | | |
|---|---|---|---|
| KR | 10-2002-0030620 | A | 4/2002 |
| KR | 10-2009-0100154 | A | 9/2009 |

* cited by examiner

LAUNDRY TREATMENT MACHINE

CROSS-REFERENCE TO RELATED APPLICATION(S)

This application claims priority under 35 U.S.C. §119 to Korean Patent Application No. 10-2012-0119175, filed on Oct. 25, 2012, and No. 10-2012-0119176, filed on Oct. 25, 2012, whose entire disclosures are hereby incorporated by reference.

BACKGROUND

1. Field

The present disclosure relates to a laundry treatment machine.

2. Background

Generally, laundry treatment machines refer to various apparatuses that treat laundry by applying physical and chemical actions to laundry. Examples of laundry treatment machines include a washing machine that separates contaminants from clothing and bedding (hereinafter, referred to as laundry) using chemical decomposition of water and detergent and mechanical action such as friction between water and laundry, a drying machine that dehydrates and dries wet laundry, and a refresher that sprays heated vapor to laundry to unwrinkle or sterilize laundry.

These laundry treatment machines include a main body in which laundry is treated and a lid or a door pivotably coupled to the main body to open and close a laundry loading hole. In this case, when the lid is closed, the lid may strongly hit the main body, affecting the durability of a product. Also, since the lid is formed of a metallic material or includes a glass to form a lid window, the weight of the lid increases. For these reasons, a large force is needed for a user to open the lid, and when the lid is closed, the lid may strongly hit the main body.

In order to overcome the foregoing limitations, there is a typical hinge device in which an elastic member is deformed due to the rotation of the lid and the pivoting speed of the lid is decelerated by a restoring force of the deformed elastic member. However, this hinge device has a limitation in that a repulsive force from the elastic member, i.e., a braking force for decelerating the pivoting speed of the lid cannot be uniformly delivered, causing shaking of the lid.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

The advantages and features of the present disclosure and the way of attaining them will become apparent with reference to embodiments described below in detail in conjunction with the accompanying drawings. Embodiments, however, may be embodied in many different forms and should not be constructed as being limited to example embodiments set forth herein. Rather, these example embodiments are provided so that this disclosure will be thorough and complete and will fully convey the scope to those skilled in the art. The scope of the present disclosure should be defined by the claims. Wherever possible, the same reference numbers will be used throughout the drawings to refer to the same or like parts.

Hereinafter, a laundry treatment machine according to an embodiment of the present disclosure will be exemplified as a washing machine, but the scope of the present disclosure is not limited thereto. Therefore, it should be noted that the present disclosure can also be applied to laundry treatment machines such as drying machines, washing & drying machines, and refreshers.

Figure 1:
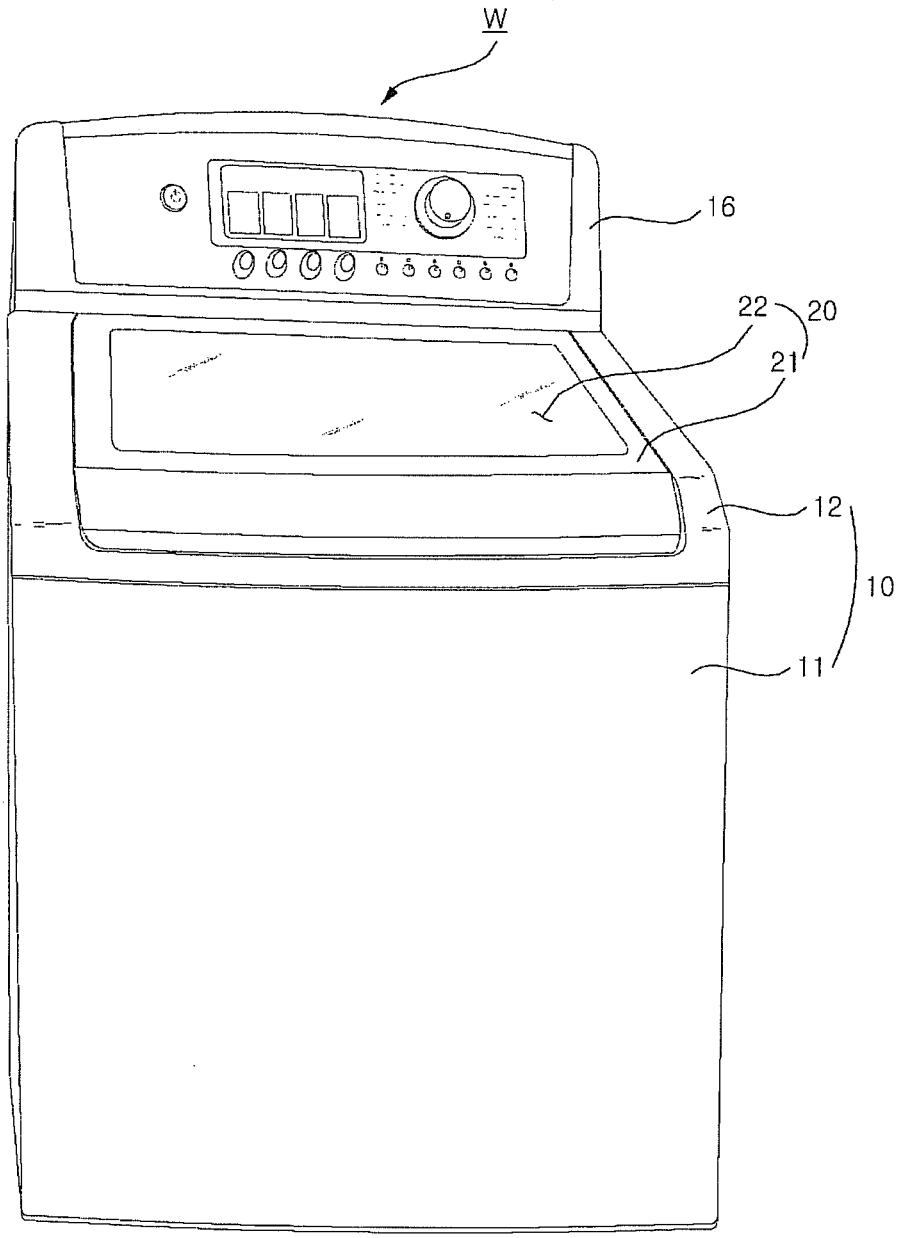
FIG. 1 is a perspective view illustrating a washing machine according to an embodiment of the present disclosure.
Figure 2:
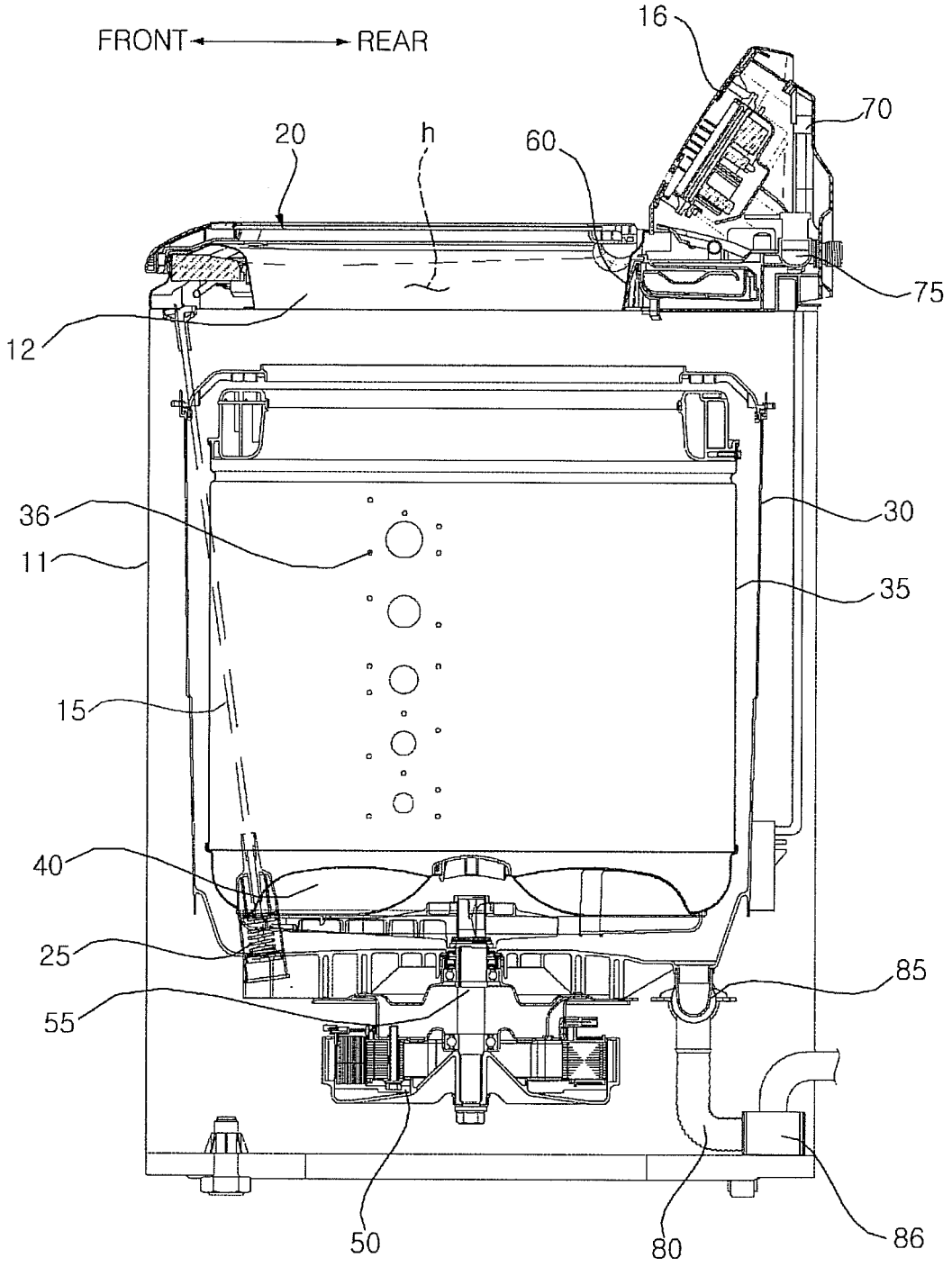
FIG. 2 is a side cross-sectional view illustrating the inside of the washing machine of FIG. 1.
Figure 3:
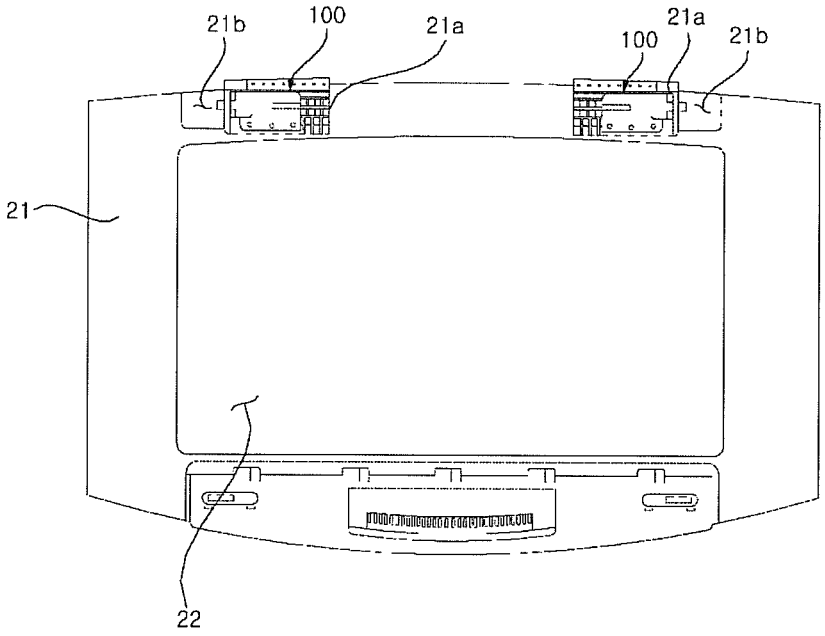
FIG. 3 is a view illustrating a coupling relationship of a lid and a hinge part of FIG. 1.

FIG. 1 is a perspective view illustrating a washing machine according to an embodiment of the present disclosure. FIG. 2 is a side cross-sectional view illustrating the inside of the washing machine of FIG. 1. FIG. 3 is a view illustrating a coupling relationship of a lid and a hinge part of FIG. 1.

Referring to FIGS. 1 and 2, a washing machine W may include a main body 10 and a lid 20 pivotably disposed at the main body 10. The main body 10 may include a cabinet 11 having an upper portion opened and a top cover 12 having a laundry loading hole h through which laundry is loaded into and unloaded from the cabinet 11. In this case, the lid 20 may be supported by the top cover 12, and may open and close the laundry loading hole h.

A control panel 16 may include an input unit for receiving various control commands for the operation of the washing machine W and a display unit for displaying the operation state of the washing machine W.

An outer tub 30 may be suspended in the cabinet by a support member 15, and may hold wash water. An inner tub 35 may be rotatably disposed inside the outer tub 30. A damper 25 may be disposed at the lower end of the support member 15 to absorb the shaking of the outer tub 30 due to the vibration generated during the rotation of the inner tub 35. Contaminants of laundry may be effectively removed by a frictional action between a pulsator 40 and wash water contained in the inner tub 35 and whirling water generated by the rotation of the pulsator 40.

The inner tub 35 may have a plurality of water holes 36 such that wash water can flow between the inner tub 35 and the outer tub 30. A motor 50 may be disposed under the outer tub 30 to rotate the pulsator 40. The inner tub 35 and/or the pulsator 40 may be rotated by a shaft 55 of the motor 50.

A clutch (not shown) that connects the shaft 55 to the inner tub 35 and/or pulsator 40 may be provided to rotate both or either of the inner tub 35 and the pulsator 40. The inner tub 35 and the pulsator 40 may rotate at the same time or only the pulsator 40 may rotate according to the operation of the clutch.

A detergent box 60 may be withdrawably provided to the top cover 12 to contain detergent, and a water supply hose 70 for supplying wash water connected to an external water source such as a household faucet and a water supply valve 75 for controlling wash water flowing through the water supply hose 70 may be provided to the top cover 12. When the water supply valve 75 is opened to supply wash water from the external water source, wash water supplied may flow into the detergent box 60, and then may be mixed with detergent contained the detergent box 60 to be supplied into the inner tub 35.

A water exhaust hose 80 may be provide at the lower end of the outer tub 30 to discharge wash water out of the outer tub 30, and a water exhaust control valve 85 may be provided to control wash water discharged through the water exhaust hose 80. Also, a drain pump 86 may be provided to pump wash other to the outside.

The lid 20 may be pivotably coupled to the top cover 12 such that a user can open and close the laundry loading hole h. In this case, in order for a user to easily open the lid 20, when the lid 20 is in a closed state, the front end portion of the lid 20 may protrude compared to the top cover 12.

Referring to FIG. 3, the lid 20 may include a lid frame 21 and a lid window 22 supported by the lid frame 21. The lid frame 21 may be formed of a synthetic resin through injection molding, and the lid window 22 may be formed of a transparent member such as tempered glass Since the lid window 22 having a stiffness stronger than the lid frame 21 is provided at the central portion of the lid frame 21, the structural stability can be improved, and thus a distortion of the lid frame 21 can be prevented.

Figure 4A:
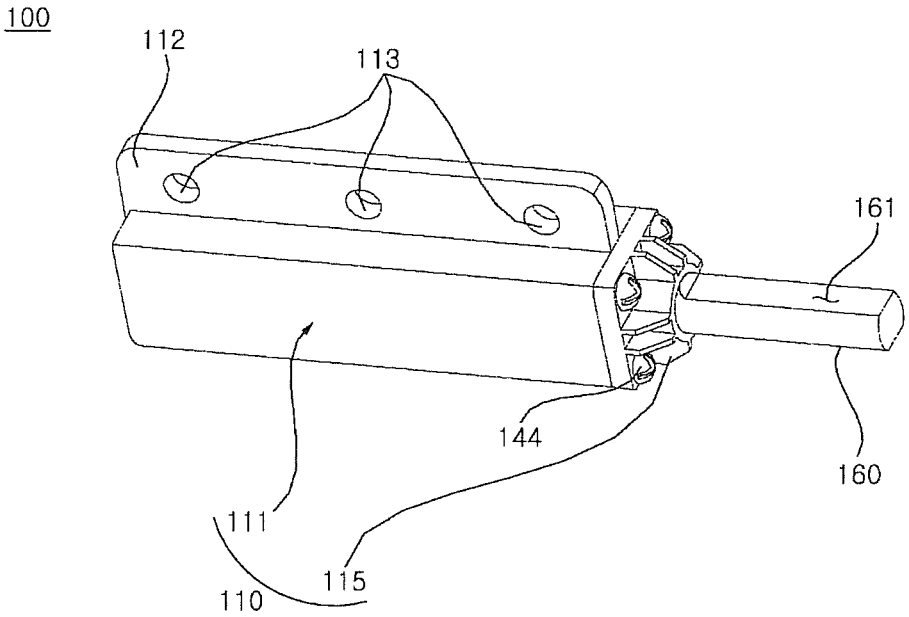
FIG. 4A is a perspective view of a hinge part.
Figure 4B:
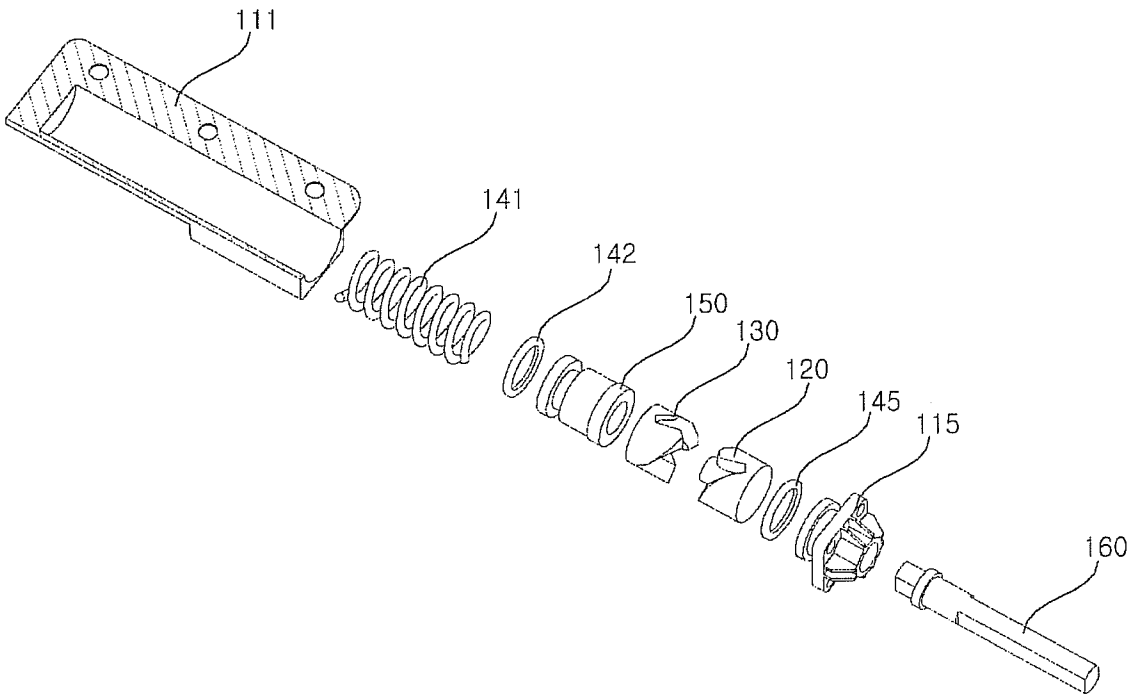
FIG. 4B is an exploded perspective view of the hinge part.
Figure 4C:
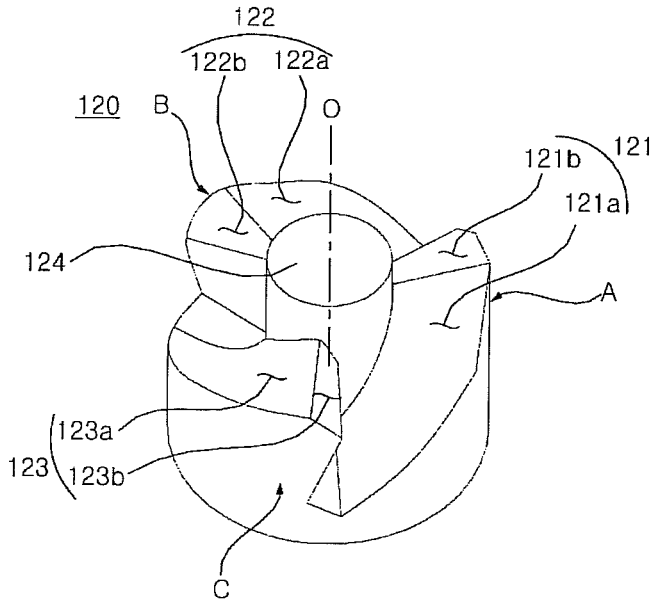
FIG. 4C is a view of a fixing cam.
Figure 4D:
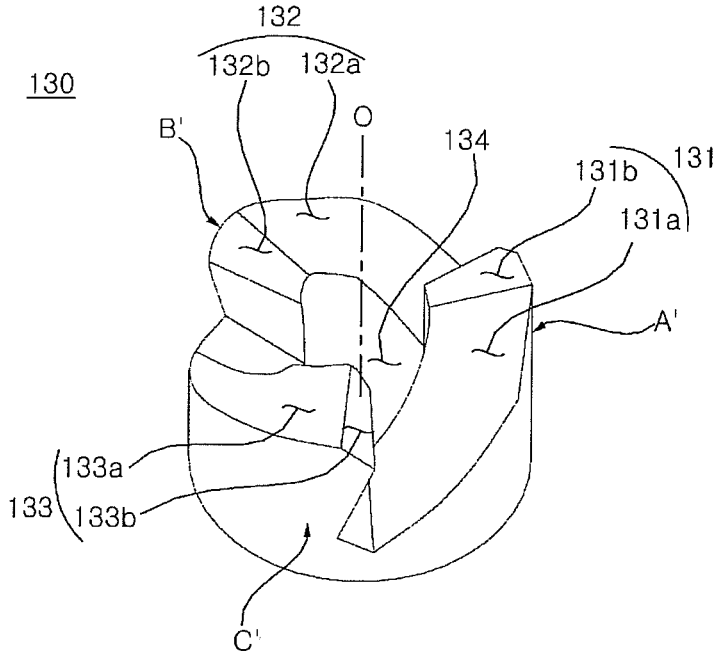
FIG. 4D is a view of a moving cam.
Figure 5A:
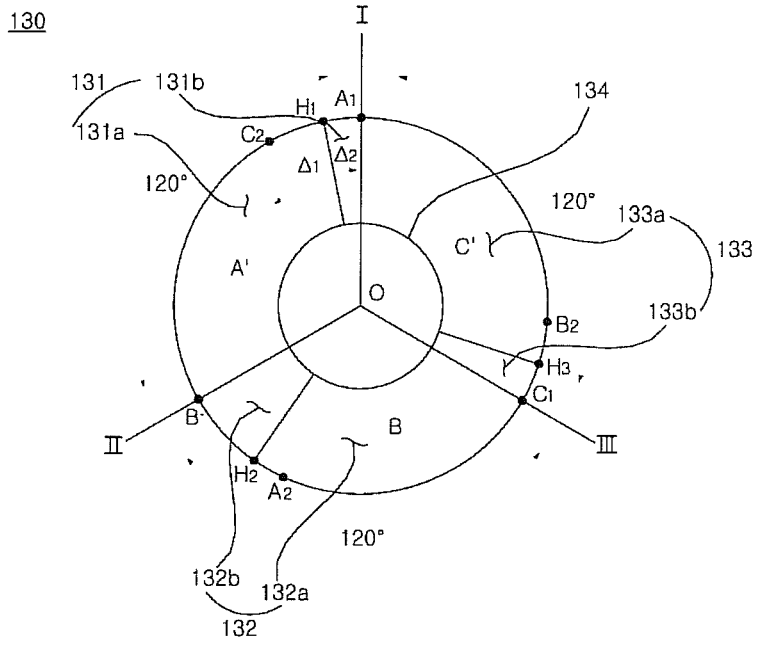
FIG. 5A is a view illustrating contact surfaces of a moving cam.
Figure 5B:
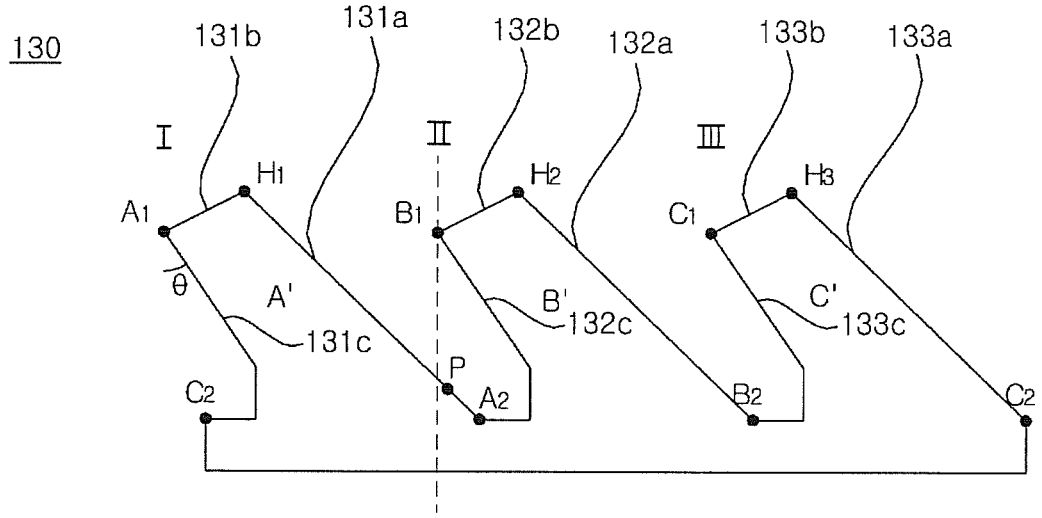
FIG. 5B is a development view of a moving cam.
Figure 6A:
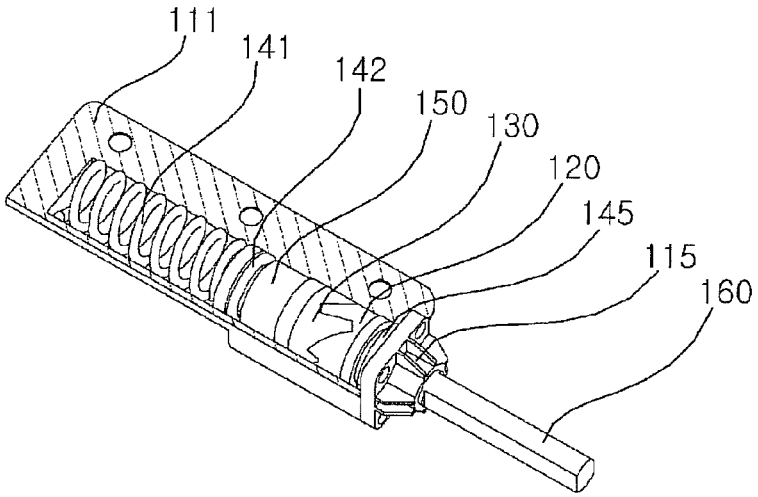
FIG. 6A is a view illustrating an internal configuration of a hinge part in a state where a lid is opened.
Figure 6B:
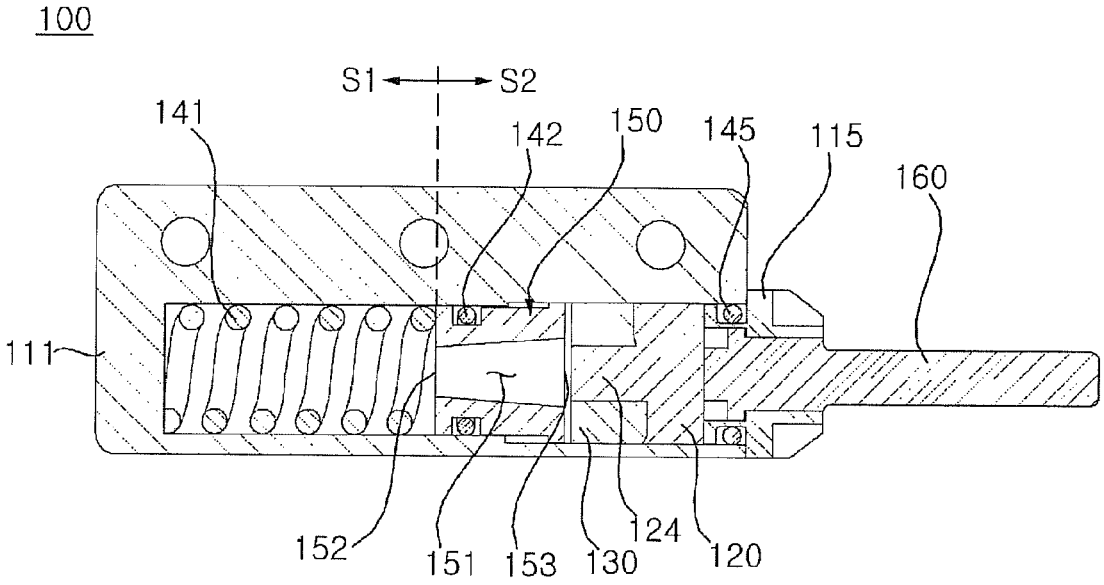
FIG. 6B is a cross-sectional view of FIG. 6A.
Figures 7A, 7B:
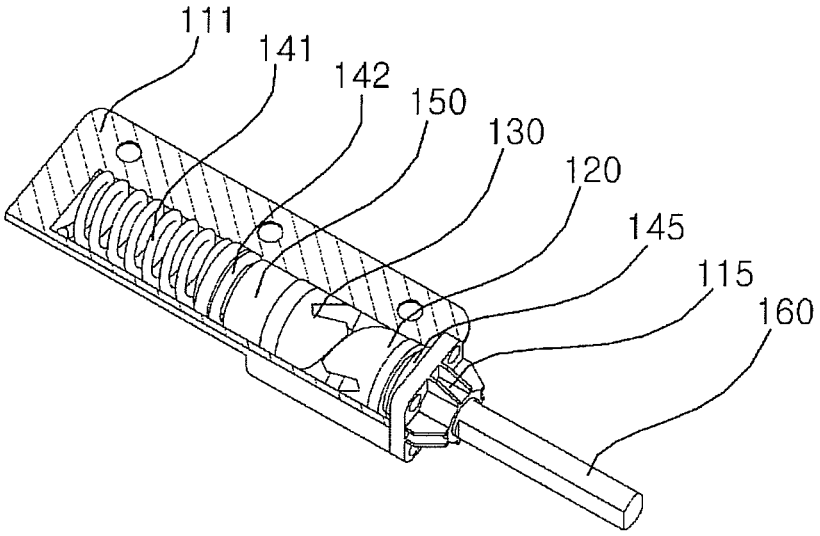
FIG. 7A is a view illustrating an internal configuration of a hinge part in a process where a lid is pivotably closed.
FIG. 7B is a cross-sectional view of FIG. 7A.

FIG. 4A is a perspective view of a hinge part, FIG. 4B is an exploded perspective view of the hinge part, FIG. 4C is a view of a fixing cam, and FIG. 4D is a view of a moving cam. FIG. 5A is a view illustrating contact surfaces of a moving cam. FIG. 5B is a development view of a moving cam. FIG. 6A is a view illustrating an internal configuration of a hinge part in a state where a lid is opened, and FIG. 6B is a cross-sectional view of FIG. 6A. FIG. 7A is a view illustrating an internal configuration of a hinge part in a process where a lid is pivotably closed, and FIG. 7B is a cross-sectional view of FIG. 7A.

Referring to the foregoing drawings, a hinge part 100 may support the lid 20 such that the lid 20 can pivot about the main body 10. The hinge part 100 may include a hinge housing 110 filled with a fluid having a certain viscosity, an elastic member 141 disposed in the hinge housing 110, and a pair of cams 120 and 130. The elastic member 141 may be a compression spring.

At least one of the pair of cams 120 and 130 may include a contact surface formed so as to have a height difference along a circumferential direction. One of cams 120 and 130 may rotate in linkage with the lid 20 (e.g., rotate relative to the lid 20), and the other cam may be maintained in contact with the rotating cam. Accordingly, one cam may move along its own center of rotation O (or pivoting line of the lid 20) according to the shape of the contact surface formed on at least one of two cams.

The cam refers to a device that transforms rotary motion into reciprocating motion or vice-versa. Generally, in the cam device, as a rotary cam in which a distance from a certain point on the circumference to the axis of rotation is not uniform rotates, a contacted cam follower of the circumference of the rotary cam moves in an orthogonal direction to the axis of rotation of the rotary cam, but transformation into reciprocating motion according to the axis of rotation of the rotary cam is possible according to the shape or the structure of the cam and the cam follower.

In this embodiment, the pair of cams may include a first cam rotating in linkage with the lid 20 and a second cam disposed in contact with the rotary cam to vary in relative distance from the first cam according to the rotation of the first cam. That is, when one (first cam) of two cams rotates in linkage with the lid 20, the contact surface of one cam (first cam) may slide along the contact surface of the other cam (second cam), and any one of two cams may move. Here, "one of two cams" may become the first cam or the second cam according to embodiments.

More specifically, according to the definition of the foregoing cams, the first cam may be defined as a rotary cam rotating relative to the lid 20 in mechanical linkage with the lid 20, and the second cam may be defined as a cam follower reciprocating by the first cam. However, it should be noted that in the defining of the hinge part, when the first cam rotates, the second cam need not necessarily reciprocate. According to embodiments, the first cam (see 130 of FIG. 7A) may reciprocate at the same time when rotating in linkage with the lid 20.

Also, the contact surface of the first cam and the contact surface of the second cam which contact each other need not necessarily have the same shape. That is, it is sufficient that a contact surface varying in height (e.g., inclined contact surface) according to the circumferential direction is formed on at least one of the first and second cams. Here, the height of the contact surface may be defined as a distance from a certain plane orthogonal to the axis of rotation of the cam to any point on the contact surface.

The hinge housing 110 may include a housing body 111 having one end opened and a housing cover 115 closing the opened one end of the housing body 111. A support plate 112 may be formed on the housing body 111, and a plurality of coupling holes 113 may be formed in the support plate 112 to receive coupling members 144 for coupling the hinge part 110 to the top cover 12. The housing cover 115 may have a through hole that a shaft 160 penetrates, and may be coupled to the housing body 111 by the coupling members 144.

Referring to FIG. 3, the hinge part 100 may be disposed in pair. The center of rotation or the shaft 160 of the pair of hinge parts 100 may be aligned on the same axis, and may be symmetrically disposed at the rear end of the lid 20. A receiving part 21*a* may be recessed at both sides of the rear end of the lid frame 21 to receive the hinge part 100, and a certain space 21*b* may be further formed around the end portion of the shaft 160 to receive a member (not shown) coupled with the shaft 160. Although not shown, a frame member may be further provided to be coupled to a lower side of the lid frame 21 such that the lid window 22 is not separated and the internal configuration of the lid frame 21, particularly, the hinge part 10 is not exposed to the outside.

The lid 20 may be supported by one pair of hinge parts 100, and each of hinge parts 100 may be configured in the same manner. Thus, since damping forces or supporting forces supported by each hinge part 100 are the same, a deformation such as distortion can be prevented even though the opening/closing of the lid 20 is repeated.

Meanwhile, a division member 150 or a piston may be disposed between the elastic member 141 and one of the pair of cams moving along the axial direction during the rotation of the lid 20, deforming the elastic member 141 in response to the displacement of the moving cam, and may divide the inside of the hinge housing 110 into a first space S1 in which the elastic member 141 is disposed and a second space S2 in which the pair of cams 120 and 130 is disposed (see FIGS. 5B and 6B). A fluid passage 151 may be formed in the division member 150 such that a fluid can move between the first space S1 and the second space S2. Accordingly, when the length of the elastic member 141 varies according to the movement of the cam and thus the first space S1 and the second space S2 is reduced or extended, a fluid may move between the first space S1 and the second space S2 in response thereto (see arrow of FIG. 7B). In this case, due to a viscous force according to the movement of the fluid, a certain damping force may be provided during the operation of the lid 20.

The hinge part 100 may include a hinge housing 110 filled with a fluid having a certain viscosity, an elastic member 141 disposed in the hinge housing 110, and a pair of cams 120 and 130 having contact surfaces 121, 122, 123, 131, 132 and 133 with height differences along the circumferential direction. The shaft 160 may connect the hinge part 100 to the top cover 12, and may be a fixed axis to which its own rotation is restricted. A cuffing surface 161 (also referred to herein as a cut surface or flat surface) may be formed along the outer circumferential surface of the round bar, and a fixing member such as a bracket having an insertion hole corresponding to the sectional shape of the shaft 160 may be provided to the top cover 12.

The pair of cams 120 and 130 may include a fixing cam 120 fixedly coupled to the shaft 160 and restricted in its own rotation independently of the rotation of the lid 20, and a moving cam 130 rotating in linkage with the lid 20 and varying in distance from the fixing cam 120 according to the rotation angle thereof. For example, the fixing cam 120 may be rotationally fixed relative to the lid and the moving cam 130 may be rotationally fixed relative to the hinge housing to move laterally within the hinge housing. The contact surfaces 121, 122 and 123 of the fixing cam 120 and the contact surfaces 131, 132 and 133 of the moving cam 130 may be mutually in contact with each other. Accordingly, the contact surfaces 121, 122 and 123 of the fixing cam 120 may slide along the contact surfaces 131, 132 and 133 of the moving cam 130 during the pivoting of the lid 20, and the location of the moving cam 130 may vary with the shapes of the contact surfaces, particularly, the height differences of the contact surfaces.

The contact surface (e.g., 131) of the cam may have a slope varying in height along the circumferential direction based on the central axis O (see FIG. 4D). In this case, the slope direction of the contact surface may be determined such that the moving cam 130 can move in a direction of compressing the elastic member 141 when the lid 20 pivots to close the laundry loading hole h. In this case, the division member 150 may compress the elastic member 141 while moving according to the displacement of the moving cam 130. In this structure, a restoring force by the compressed elastic member 141 may generate a torque in a direction where the lid 20 is opened by an interaction between the contact surfaces of the moving cam 130 and the fixing cam 120, and thus the closing speed of the lid 20 may be decelerated. That is, the torque may serve such that a user can open the lid 20 only with a weak force during the opening of the lid 20.

The fluid passage 151 may have a first hole 152 opened toward the first space S1 and a second hole 153 opened toward the second space S2. The areas of the first and second holes 152 and 153 may be different from each other. This structure may enable differences of viscosity according to the movement of the fluid when the lid 20 is closed and opened. Particularly, the sectional area of the first hole 132 may be formed to be smaller than that of the second hole 153 such that when the lid 20 is closed, a larger damping force can be provided than when the lid 20 is opened. In this case, the fluid passage 151 may be formed to have an increasingly large inner diameter from the first hole 152 to the second hole 153.

Comparing FIG. 7B with FIG. 6B, when the division member 150 is moved by the closing operation of the lid 20 to compress the elastic member 141, the first space S1 may be reduced whereas the second space S2 may be extended. Accordingly, the fluid inside the hinge housing 110 may move from the first space 51 to the second space S2, providing a certain damping force.

The hinge part 100 may further include an O-ring 142 that may provide an airtight seal between the outer circumferential surface of the division member 150 and the inner circumferential surface of the hinge housing 110 and an O-ring 145 that may provide an airtight seal between the housing body 111 and the housing cover 115.

Referring to FIG. 4C, the fixing cam 120 may include a first cam leg A, a second cam leg B, and a third cam leg C (also referred to herein as an engagement protrusion). The first cam leg A, the second cam leg B, and the third cam leg C may engage with a first cam leg A', a second cam leg B', and a third cam leg C' of the moving cam 130. The first cam leg A, the second cam leg B, and the third cam leg C may have a ring-shaped partition structure varying in height of the end portion thereof along the circumferential direction, respectively, and the contact surfaces 121, 122 and 123 may be formed on the end portion of the cam legs A, B and C, respectively.

In this case, the contact surfaces formed on at least one of the first to third cam legs A, B and C may have a normal inclination surface and a reverse inclination surface that extend to both sides at different inclination angles based on the peak point.

More specifically, the contact surface 121 of the first cam leg A may have a normal inclination surface 121*a* corresponding to a B-D section (see FIG. 8) between the pivoting angles d1 and d3 of the lid 20 and a reverse inclination surface 121*b* corresponding to an A-B section between the pivoting angles 0 (closed state of lid 20) and d1 of the lid 20. Similarly, the contact surface 122 of the second cam leg B may have a normal inclination surface 122*a* and a reverse inclination surface 122*b*, and the contact surface 123 of the third cam leg C may have a normal inclination surface 123*a* and a reverse inclination surface 123*b*.

The normal inclination surfaces and the reverse inclination surfaces may incline in opposite directions to both sides based on peak points H1, H2 and H3, respectively. Referring to FIGS. 5A and 5B, the first contact surface 131 may include a normal inclination surface 131*a* downwardly inclining from the peak point H1 to an end point A2 at an inclination angle Δ1, and a reverse inclination surface 131*b* downwardly inclining from the peak point H1 to a start point A1 at an inclination angle Δ2. The inclination angles Δ1 and Δ2 of the inclination surfaces may be values having different signs, but the values need not be constant values in the corresponding sections. For example, the inclination angle Δ1 may vary between the peak point H1 and the end point A2 such that the inclined surface is curved or contoured.

Also, the fixing cam 120 may further include an insertion protrusion 124 protruding to the moving cam 130. The insertion protrusion 124 may be inserted into an insertion hole 134 or recess (see FIG. 4D) formed in the moving cam 130, guiding the movement of the moving cam 130. In the displacement section where the location of the moving cam 130 varies according to the operation of the lid 20, the insertion protrusion 124 may be continuously maintained in a state of being inserted into the insertion hole 134.

Referring to FIG. 4D, the moving cam 130 may include the first cam leg A', the second cam leg B', and the third cam leg C' similarly to the fixing cam 120. The first cam leg A', the second cam leg B', and the third cam leg C' may have contact surfaces that contact the contact surfaces of the fixing cam, respectively.

The contact surface 131 formed on the first cam leg A' of the moving cam 130 may correspond to the contact surface 121 formed on the first cam leg A of the fixing cam 120. The contact surface 132 formed on the second cam leg B' of the moving cam 130 may correspond to the contact surface 122 formed on the second cam leg B of the fixing cam 120. The contact surface 133 formed on the third cam leg C' of the moving cam 130 may correspond to the contact surface 123 formed on the third cam leg C of the fixing cam 120. During the pivoting of the lid 20, the contact surfaces 131, 132 and 133 of the moving cam 130 may slide along the contact surfaces 121, 122 and 123 of the fixing cam 120 corresponding thereto, respectively.

Meanwhile, similarly to the fixing cam 120, the contact surface 131 of the first cam leg A' may include a normal inclination surface 131*a* and a reverse inclination surface 131*b*, and the contact surface 132 of the second cam leg B' may include a normal inclination surface 132*a* and a reverse inclination surface 132*b*. Also, the contact surface 133 of the third cam leg C' may include a normal inclination surface 133*a* and a reverse inclination surface 133*b*.

The normal inclination surfaces 131*a*, 132*a* and 133*a* of the moving cam 130 may slide along the normal inclination surfaces 121*a*, 122*a* and 123*a* of the fixing cam 120 within a rotation angle B-D of the lid 20, respectively. That is, the normal inclination surfaces 131*a*, 132*a* and 133*a* of the moving cam 130 may be in linkage with the normal inclination surfaces 121*a*, 122*a* and 123*a* of the fixing cam 120, generating a torque in a direction where the lid 20 is opened.

The reverse inclination surfaces 131*b*, 132*b* and 133*b* of the moving cam 130 may slide along the reverse inclination surfaces 121*b*, 122*b* and 123*b* of the fixing cam 120 within a rotation angle A-B of the lid 20, respectively. That is, the reverse inclination surfaces 131*b*, 132*b* and 133*b* of the moving cam 130 may be in linkage with the reverse inclination surfaces 121*b*, 122*b* and 123*b* of the fixing cam 120, generating a torque in a direction where the lid 20 is closed. At a location where the lid 20 is completely closed, the reverse inclination surfaces 131*b*, 132*b* and 133*b* of the moving cam 130 may be maintained in contact with the reverse inclination surfaces 121*b*, 122*b* and 123*b* of the fixing cam 120.

Referring to FIGS. 5A and 5B, at least one of a pair of cams at a hinge part according to an embodiment of the present disclosure may have contact surface 131, 132 and 133 formed at three sections, respectively. Accordingly, when a pair of cams rotate while being in contact with each other, the cams may be supported by each other by three or more sections, enabling a stabler operation.

For this, at least one (hereinafter, it will be noted that the moving cam 130 is exemplified, but the fixing cam 120 can be formed in a form corresponding thereto) of the pair of cams may be formed to include at least three cam legs A', B' and C'. Also, the contact surfaces may be formed on the end portions of the cam legs A', B' and C', respectively.

When a distance between the pair of cams increases in a process where the lid 20 is pivoted for closing, the contact area between the contact surfaces of the pair of cams may be reduced. Accordingly, in a structure where the contact surfaces are formed at two sections in one of the pair of cams, since each cam is supported by two contact surfaces existing symmetrically based on the center of the cam, shaking of cams may occur. Certainly, when the outer circumferential surfaces of the cams adhere completely to the inner circumferential surface of the hinge housing, the shaking of the cam can be prevented. However, since one of cams needs to move in the hinge housing 110, a minute gap between the cam and the hinge housing 110 may exist, and thus there is a limitation in supporting the cam without it shaking with only two contact surfaces existing substantially symmetrically to the center of the cam. Accordingly, in this embodiment, there is proposed a hinge part which includes a cam having contact surfaces 131, 132 and 133 formed at three sections A', B' and C' that are divided by a certain rotation angle along the circumferential direction.

In FIG. 5A, one of the pair of cams, i.e., the moving cam 130 that moves during the pivoting of the lid 20 is shown, and a description of the present disclosure will be made based thereon, but the present disclosure is not limited thereto. For example, a substantially identical structure may be applied to the other cam, i.e., the fixing cam 120 that is engaged with the moving cam 130. However, when the contact surface formed on one of the pair of cams has a concave (or convex) shape, the other cam engaged therewith may have a convex (or concave) shape to enable the surface contact between the contact surfaces of each cam.

When the moving cam 130 is viewed from the axial direction, the cam may be divided into three sections A', B' and C' at a certain rotation angle based on the center O of the cam, and the contact surfaces may be formed at each section. In this case, the three section A', B' and C' may be divided based on the cam leg of the moving cam 130.

In a pair of sections adjacent to each other among the three sections, a start point B1 of the contact surface 132 formed on one section (e.g., B') may overlap the contact surface 131 formed on the other section (e.g., A') in an axial projection drawing of the cam. That is, a rear surface 132*c* opposite to the contact surface 132*a* formed on the second cam leg B' may incline at a certain angle with respect to a vertical line II, and thus the end point A2 of the contact surface of the first cam leg A' may be located at a further rotated place under the start point B1 of the contact surface 132 formed on the second cam leg B', i.e., at a point where the angle from the start point A1 of the first section becomes larger at a point II. Moreover, the amount of overlap of each leg to an adjacent section may be varied. That is, leg B' may overlap leg A' such that point H2 is positioned past point A2 as shown in FIG. 5A, or such that point H2 is positioned before point A2 as shown in FIG. 5B.

This structure may be applied to a location relationship between the start point A1 of the contact surface formed on the first can leg A' and an end point C2 of the contact surface formed on the third cam leg C' and a location relationship between a start point C1 of the contact surface formed on the third cam leg C' and an end point B2 of the contact surface formed on the second cam leg B'.

Meanwhile, as described above, the fixing cam 120 may include the substantially same three cam legs (see A, B and C of FIG. 4C) as the moving cam 130, and the each cam leg may interact with the moving cam 130 between the start point and the end point of the contact surface of the moving cam 130. In other words, when taking a certain point P on the contact surface of the fixing cam 120, during the rotation of the lid 20, the point P may also be located between the start point and the end point of the contact surface formed on the moving cam 130, particularly, between the vertical line (e.g., II) and the end point (e.g., A2).

Even though an interval between the start points of each cam leg is assumed to be about 120 degrees, that is, angles between the vertical lines I and II, II and III, and III and I are about 120 degrees, an angle between the start point (e.g., B1) and the end point (e.g., B2) of any cam leg may be allowed to become larger than about 120 degrees. Accordingly, even in a rotation section of about 120 degrees or more, the contact surface of the fixing cam 120 and the contact surface of the moving cam 130 can be mutually supported therebetween.

A maximum opening angle d3 of the lid 20 may be set so as not to exceed about 120 degrees. For example, when the opening degree of the lid 20 reaches about 120 degrees, the lid 20 may be stopped by a stopper disposed in the top cover 12 to restrict further pivoting of the lid 20. However, the structure of stopping the pivoting of the lid 20 may allow a certain clearance instead of strictly restricting the pivoting of the lid 20 within a predetermined maximum opening angle of the lid 20. That is, when a strict restriction is performed by an external force within the maximum opening angle during the opening of the lid 20, the hinge part may be damaged by an impact. Accordingly, a braking section may be provided at a certain section that exceeds the maximum opening angle. Accordingly, in consideration of this braking section, an actual opening angle of the lid may reach about 120 degree or more, and in this embodiment, the stability and accuracy of the operation of the hinge part can be secured even by the braking section.

Figure 8:
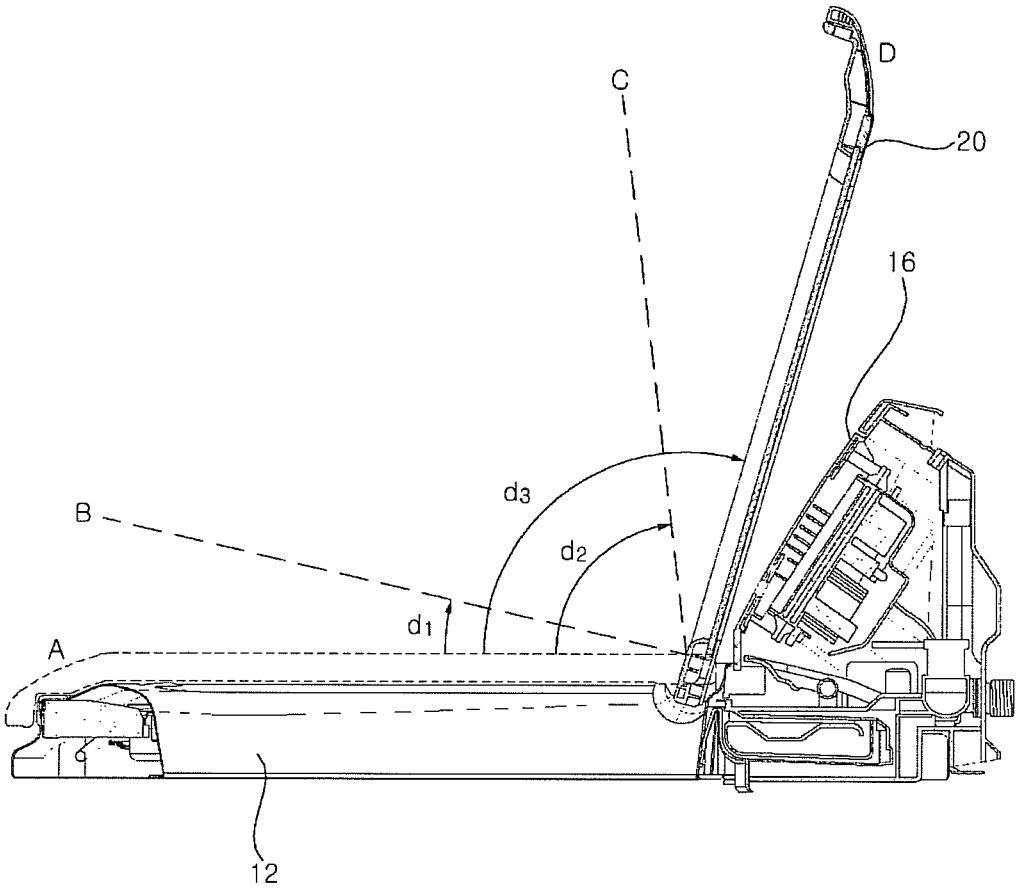
FIG. 8 is a side view illustrating a pivoting movement of a lid.

FIG. 8 is a side view illustrating a pivoting movement of a lid. Referring to FIG. 8, when a pivoting angle of the lid 20 from the closed location A to the maximally opened location D is defined as an opening angle, the lid 20 may automatically pivot from a point C where the opening angle is d2 to a point D without an additional external force by a user during the opening of the lid 20. When the lid 20 is opened only by an external force of a user, the lid 20 may be automatically opened from a point where the opening angle is about 90 degrees or more. However, in this embodiment, since a torque is exerted by the hinge part 100 in a direction where the lid 20 is opened, the lid 20 may be automatically opened even in a section (d2<90) where the opening angle is less than about 90 degrees. The opening angle d2 may be set to be about 80 degrees.

The maximum opening angle d3 of the lid 20 may be set to be about 110 degrees. In one embodiment, a stopper (not shown) may be further provided such that the lid 20 does not pivot beyond the maximum opening angle. Alternatively, the pivoting of the lid 20 may be limited by the contact with the control panel 16.

The pivoting of the lid 20 may be decelerated or stopped in a section between the opening angles d1 and d2. The direction of the torque applied by the hinge part 100 may be opposite to that of a torque by the self-weight of the lid 20. In addition, when considering the viscous force according to the movement of the fluid, it is apparent that the pivoting speed of the lid 20 is decelerated in the above section. Furthermore, since the torque acting by the hinge part 100 and the viscous force due to the movement of the fluid inside the hinge housing 110 serve as factors that offsets the torque by the self-weight of the lid 20, the lid 20 may also be maintained in a still state in the section between the opening angles d1 and d2 by an appropriate combination of the foregoing factors. As the capacity of the washing machine increases, the size of the lid 20 may also increase, making it difficult for a user to grip the front end of the lid 20 and then lift the lid 20 to the point C. Accordingly, when the pivoting of the lid 20 is stopped at a certain section within user's reach, convenience in use can be improved when laundry is loaded and unloaded.

Meanwhile, when the lid 20 reaches a section where the opening angle is less than d1 during the closing of the lid 20, the lid 20 may be automatically closed. In this section, the torque by the self-weight of the lid 20 may be stronger that those of other sections. Accordingly, when the shape of the contact surface, the elastic modulus of the elastic member 141, and the viscous force of the fluid are controlled, the lid 20 may be allowed to be automatically closed.

However, in addition, in at least one of the fixing cam 120 and the moving cam 130, the cam leg (hereinafter, cam leg A' of the moving cam 130) may include the first contact surface 131*a* allowing a torque to be exerted in a direction where the lid 20 is opened and the second contact surface 131*b* inclining to the opposite direction to the first contact surface 131*a*. Thus, the moving cam 130 and the fixing cam 120 may contact each other via the first contact surface 131*a* between the points B and D, and may contact each other via the second contact surface 131*b* between the points A and B. As described above, the contact surfaces formed on each cam may contact each other, by forming the contact surfaces 121*a* and 121*b* corresponding to the contact surfaces 131*a* and 131*b* of the moving cam 130 on the fixing cam 120 as well. The opening angle d1 of the point A may be set to be about 25 degrees.

In the laundry treatment machine according to the embodiment of the present disclosure, a sufficient support force for the lid 20 can be secured, and thus it is possible to more effectively deal with the increase of the weight of the lid 20, by more broadly securing the contact area between both cams constituting the hinge part.

Also, since the contact section between both cams constituting the hinge part is configured to become three or more sections, an interaction between both cams may be more stably performed, and thus the lid can stably operate without shaking.

Furthermore, the laundry treatment machine has an effect of reinforcing the stiffness of the hinge part.

Figure 9:
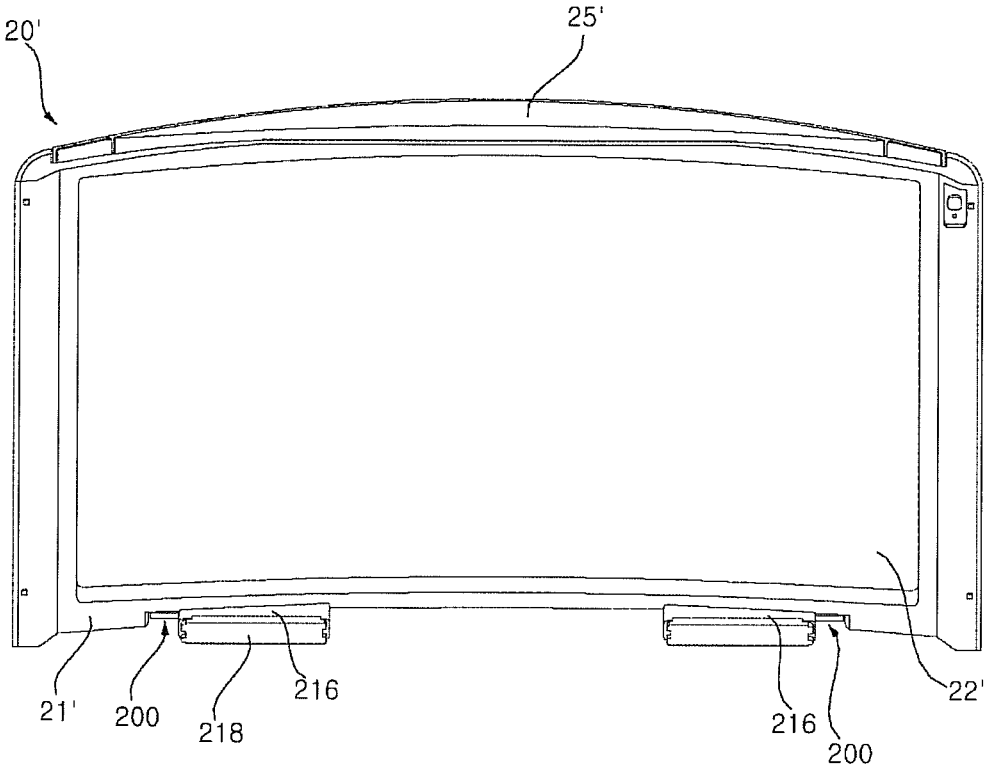
FIG. 9 is a view illustrating a lid according to another embodiment of the present disclosure.
Figure 10:
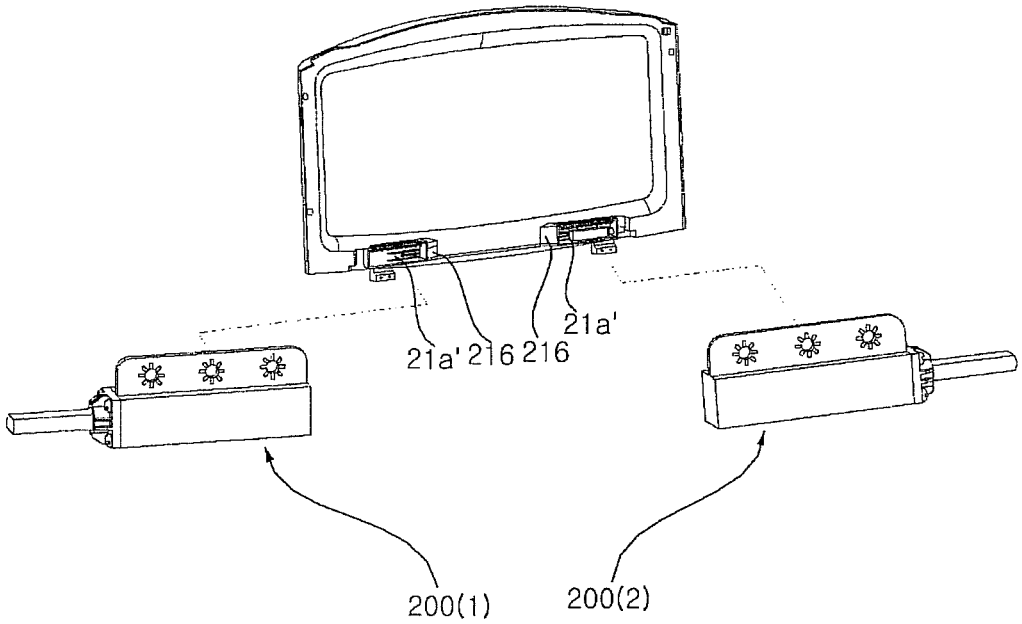
FIG. 10 is an exploded perspective view illustrating a lid and a hinge part shown in FIG. 9.

FIG. 9 is a view illustrating a lid according to another embodiment of the present disclosure. FIG. 10 is an exploded perspective view illustrating a lid and a hinge part shown in FIG. 9.

Referring to FIGS. 9 and 10, the lid 20' may include a lid frame 21', a lid window 22' supported by the lid frame 21, and a handle 25' disposed at the front end of the lid frame 21'.

The lid 20' may be pivotably supported by a pair of hinge part 30. The pair of hinge parts 30 may include a first hinge part 200(1) and a second hinge part 200(2) that are disposed at left and right sides under the rear side of the lid 20' such that the first and second hinge parts 200(1) and 200(2) are spaced from each other by a certain distance. Since the hinge part 200 is disposed under the rear side of the lid 20', the hinge part 200 is less exposed to the outside than disposed at the side surface of the lid 20'.

A hinge mounting part 216 in which the hinge part 200 is mounted may be disposed under the lid frame 21', and may downwardly protrude from the lid frame 21'. The hinge mounting part 216 may include a receiving part **21*a*' formed to receive the hinge part 200**.

A shaft 160 may connect the hinge part 200 to the top cover 12, and may be a fixed axis to which its own rotation is restricted. A cutting surface 261 may be formed along the outer circumferential surface of the round bar, and a fixing member such as a bracket having an insertion hole corresponding to the sectional shape of the shaft 260 may be provided to the top cover 12.

Since the hinge mounting part 216 downwardly protrudes from the undersurface of the lid frame 21' and thus the hinge part 200 is located at a lower side, the shaft 260 may be coupled to the top cover 12. Also, in a typical structure in which the hinge part is inserted into the lid frame, the size of the hinge part needs to increase to a certain size or more for coupling with the top cover located at a lower side. On the other hand, in this embodiment, since the hinge mounting part 216 downwardly protrudes from the lid frame 21', the hinge part 200 may be easily coupled to the top cover 12, enabling the size of the hinge part 200 to be reduced compared to a related art. A cover 218 may cover the lower portion of the hinge part 200.

The left and right hinge parts 200(1) and 200(2) may have the substantially same structure. The left and right hinge parts 200(1) and 200(2) may be symmetrically disposed, but may differ from each other in mounting location. Accordingly, the same rotary force may be provided to the left and right side of the lid 20', and the parts can be used in common. Also, the number of parts can be reduced, and it is easy to assemble.

Figure 11:
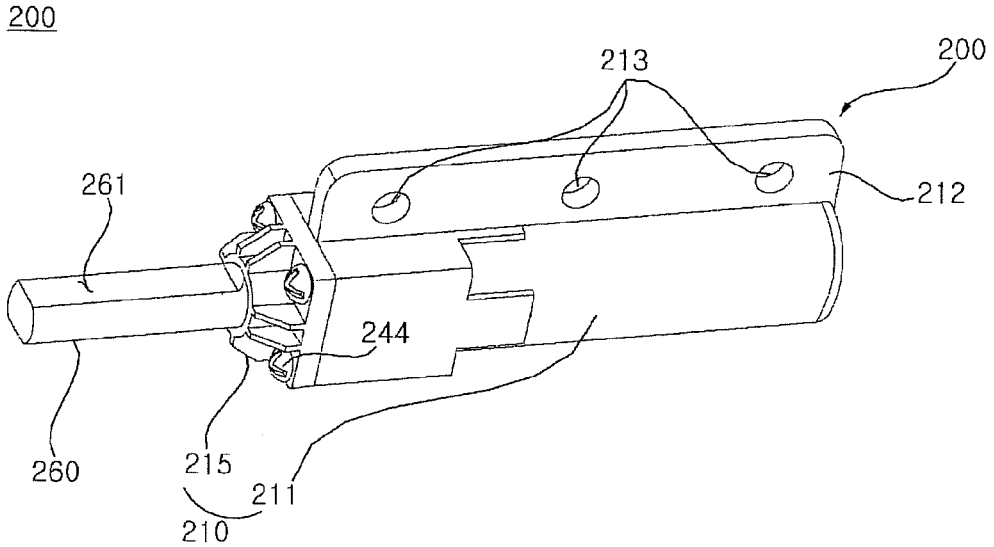
FIG. 11 is a perspective view illustrating the hinge part shown in FIG. 10.
Figure 12:
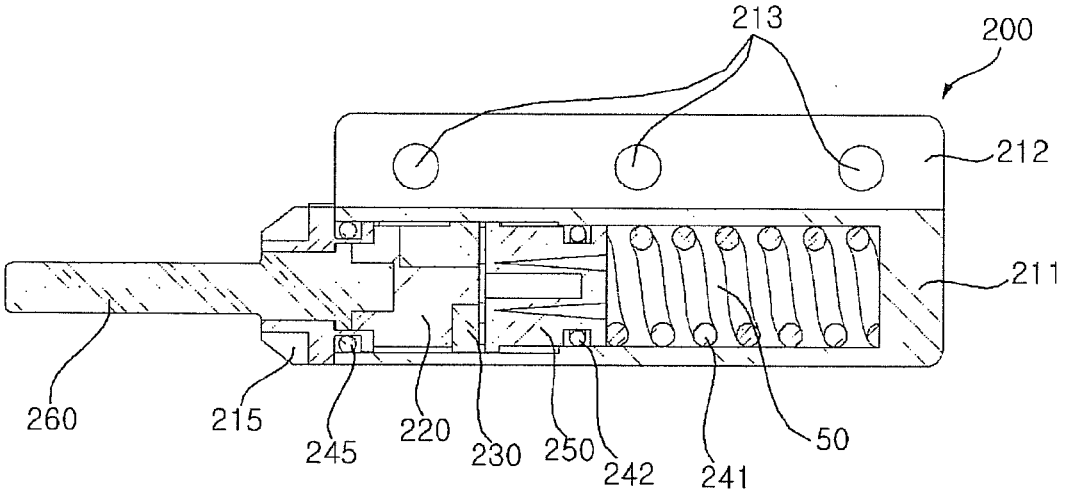
FIG. 12 is a cross-sectional view illustrating the hinge part shown in FIG. 11.
Figure 13:
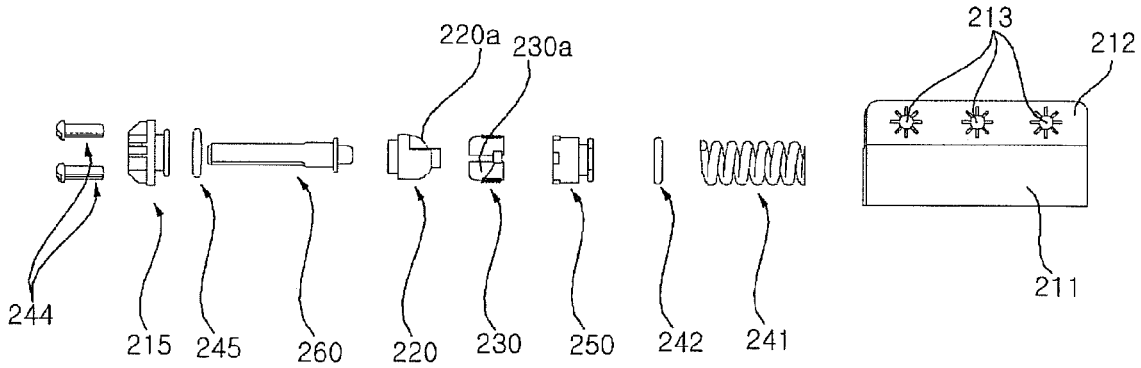
FIG. 13 is an exploded perspective view illustrating the hinge part shown in FIG. 12.

FIG. 11 is a perspective view illustrating the hinge part shown in FIG. 10. FIG. 12 is a cross-sectional view illustrating the hinge part shown in FIG. 11. FIG. 13 is an exploded perspective view illustrating the hinge part shown in FIG. 12.

Referring to FIGS. 11 to 13, the hinge part 200 may include a shaft 260, a hinge housing 210, an elastic member 241, a pair of cams 220 and 230, a piston 250, and oil.

The hinge housing 210 may include a housing body 211 having one end opened and a housing cover 215 closing the opened one end of the housing body 211. The housing cover 215 may have a through hole that the shaft 260 penetrates. Hereinafter, the pair of cams 220 and 230 refers to a first cam 220 and a second cam 230, respectively. When one 230 of the pair of cams 220 and 230 rotates in linkage with the lid 20', the contact surface of one cam may slide along the contact surface of the other cam, and thus a distance between the two cams may vary. The first cam 220 may be a fixing cam that is restricted in its rotation by the shaft 260. The second cam 230 may be a moving cam that rotates in linkage with the lid 20' and varies in distance from the first cam 220 according to the rotation angle thereof.

One end of the shaft 260 may be inserted into the hinge housing 210 to be coupled to the first cam 220, and the other end of the shaft 260 may be exposed to the outside of the hinge housing 210 to be fixedly coupled to the top cover 12.

The hinge housing 210 may have a cylindrical shape with one side opened, and may include an elastic member 241, a first cam 220, a second cam 230, a division member or a piston 250, and an oil. A support plate 212 may be formed on the outer circumferential surface of the hinge housing 210, and may be coupled to the lid 20' by a coupling member (not shown). The support plate 212 may have a plurality of coupling holes 213 which the coupling members are inserted into.

The support plate 212 may protrude from the center of one circumferential surface of the housing body 211, allowing the housing body 211 to be symmetrical in forward and backward directions. The housing body 211 may have a symmetrical shape in left-right and forward-backward directions, and thus may be installed at any location of the left and right sides of the lid 20'.

The housing cover 215 may block the opened plane of the housing body 211, and may be coupled by a coupling member 244. One end of the housing cover 215 may be inserted into the housing body 211, and an O-ring 245 that seals the housing body 211 and the housing cover 215 may be disposed between the insertion part of the housing cover 215 and the housing body 211 to prevent oil from leaking out of the housing body 211.

At least one of the first and second cams 220 and 230 may include a contact surface formed so as to have a height difference along a circumferential direction. The second cam 230 may rotate in linkage with the lid 20' and in this case, the first cam 220 and the second cam 230 may be maintained in contact with each other. Accordingly, one cam 230 may move along its own center of rotation (or axial line of rotation) according to the shape of the contact surface formed on at least one of both cams 220 and 230.

Similarly to the foregoing embodiment, an inclination surface **220*a* of the first corn 220 may have a normal inclination surface and a reverse inclination surface, and an inclination surface 230*a* of the second cam 230 may also have a normal inclination surface and a reverse inclination surface that have shapes corresponding to the inclination 220*a***.

The second cam 230 may rotate together with the pivoting of the lid 20', and at this point, the contact surface **230*a* of the second cam 230 and the contact surface 220*a* of the first cam 220 may interact. Thus, the second cam 230 may perform a linear motion, allowing the piston 250** to move.

The elastic member 241 may be deformed according to the movement of the piston 250. One end of the elastic member 241 may be coupled to the piston 250, and the other end thereof may be coupled to the housing body 211. The internal space 50 of the housing body 211 in which the elastic member 241 is disposed may be filled with a fluid (e.g., oil) having a certain viscosity. The elastic member 241 may be compressed or extended during the straight-line reciprocating motion of the second cam 230 and the piston 250. The second cam 230 may interact with the first cam 220 while reacting against an elastic force by the elastic member 24. In this case, the elastic force may finally generate a torque in a direction where the lid 20' is opened.

Meanwhile, the piston 250 and oil may act as a resistance when the lid 20' is closed, serving as a damper that decelerates the closing speed of the lid 20'. This resistance may be mainly a frictional force when the piston 250 move in a fluid with a certain viscosity, and a reaction force acting from the fluid that is compressed according to the movement of the piston 250.

The piston 250 may include an O-ring 242 on the circumferential surface thereof. The O-ring may seal the piston 250 and the hinge housing 211 that prevents oil from leaking out of the hinge housing 211.

Hereinafter, the operation of the hinge part 200 according to an embodiment of the present disclosure configured as above will be described as follows.

First, when the lid 20' is closed from the opened state, the second cam 230 may rotate in linkage with the lid 20'. In this case, the second cam 230 may straightly move due to the interaction with the first cam 220. The piston 250 may also move in the movement direction of the second cam 230, and thus the elastic member 241 may be compressed.

The elastic force or the restoring force acting from the compressed elastic member 241 may exert a strong repulsive force between the first cam 220 and the second cam 230.

The piston 250 may together move in the movement direction of the second cam 230, and thus oil inside the housing body 211 may be compressed. The second cam 230 may interact with the first cam 220 while reacting against an elastic force by the elastic member 24. In this case, the elastic force may finally generate a torque in a direction where the lid 20' is opened. Accordingly, the closing speed of the lid' 20 may be decelerated, and an impact noise generated when the lid 20' hits the top cover 12 may be reduced.

Since the hinge part 200 is disposed at both left and right sides of the lid 20' to perform the same action, the same amount of resistance or damping force may act on both left and right sides of the lid 20'. Accordingly, a typical limitation in which the lid 20' is distorted due to a non-uniformed damping force acting on both sides of the lid 20' may not occur, and a phenomenon that one of the left and right sides of the lid 20' is lifted when the lid 20' is closed may be prevented.

Meanwhile, when the lid 20' is opened from the closed state, the second cam 230 may move in the opposite direction to that of closing of the lid 20'. Even in this case, since the elastic force provided by the elastic member 241 serves to generate a torque in a direction where the lid 20' is opened, a force necessary for a user to open the lid 20' can be reduced.

Also, since the same hinge part 200 is disposed at the left and right sides of the lid 20' and thus the same rotary force or damping force is provided to the left and right sides, the weight of the lid 20' may be uniformly applied to each hinge part 200. Accordingly, the deformation (e.g., distortion) of the lid 20' can be prevented, and the durability can be improved.

Effects of the present disclosure will be clearly understood by those skilled in the art from the disclosure and the accompanying claims.

The present disclosure provides a laundry treatment machine, which can stably operate without shaking of a lid by evenly dispersing a braking force that decelerates the pivoting speed of the lid.

The present disclosure also provides a laundry treatment machine, which can secure a sufficient supporting force for a lid and thus effectively deal with an increase of the weight of the lid, by more broadly securing a contact area between both cams constituting a hinge part supporting the lid.

The present disclosure also provides a laundry treatment machine, which can achieve a stabler interaction between both cams and thus allow a lid to stably operate without shaking, by dividing a contact section between both cams constituting a hinge part supporting the lid into three sections.

The present disclosure also provides a laundry treatment machine including a hinge part supporting a lid, the stiffness of which is reinforced.

The present disclosure also provides a laundry treatment machine, which can overcome a lifting phenomenon at left and right sides of a lid assembly by applying the same force to the left and right sides of the lid assembly.

Thus, an object of the present disclosure is to provide a laundry treatment machine including: a main body having a laundry loading hole; a lid opening and closing the laundry loading hole; and at least one hinge part pivotably supporting the lid with respect to the main body, the hinge part including: a hinge housing filled with a fluid having a certain viscosity; an elastic member disposed inside the hinge housing; and a pair of cams having contact surfaces having height differences along a circumferential direction, wherein when one of the pair of cams rotates in linkage with the lid, a contact surface of the one cam slides along a contact surface of the other cam, allowing a distance between the pair of cams to vary and thus allowing the elastic member to be deformed, and a contact surface of the at least one of the pair of cams is formed in at least three sections that are divided by a certain rotation angle along a circumferential direction.

In a pair of sections adjacent to each other among the three sections, a start point of a contact surface formed in one section, on an axial projection of the cam, may overlap a contact surface formed on the other section.

At least one of contact surfaces formed in the three sections may have an angle of about 120 degrees or more between a start point and an end point.

An angle between a start point and an end point of a contact surface formed in one of the three sections may be larger than an angle between the start point of the contact surface formed in the one of the three sections and a start point of a contact surface formed in another of the three sections adjacent thereto.

An angle between the start point of the contact surface formed in the one of the three sections and the start point of the contact surface formed in the other of the three sections adjacent thereto may be about 120 degrees.

The laundry treatment machine may further include a stopper for restricting a pivoting of the lid such that a maximum opening angle of the lid is smaller than about 120 degrees.

The maximum opening degree of the lid is substantially 110 degrees.

One of the pair of cams may have an insertion hole, and the other of the pair of cams may include an insertion protrusion that is inserted into the insertion hole.

The insertion protrusion may be maintained in a state of being inserted into the insertion hole within a displacement range of a moving cam among the pair of cams.

At least one contact surface of the pair of cams may include a normal inclination surface and a reverse inclination surface that incline in opposite directions to each other based on a peak point of the at least one contact surface.

A normal inclination surface formed on one of the pair of cams may be associated with a normal inclination surface formed on the other of the pair of cams such that a torque is exerted in a direction where the lid is opened.

A reverse inclination surface formed on one of the pair of cams may be associated with a reverse inclination surface formed on the other of the pair of cams such that a torque is exerted in a direction where the lid is closed.

At a closed location, the reverse inclination surface formed on the one of the pair of cams may contact the reverse inclination surface formed on the other of the pair of cams.

The contact surface may include a normal inclination surface and a reverse inclination surface that incline in opposite directions to each other based on a peak point of the at least one contact surface, and in a pair of sections adjacent to each other among the three sections, at least a portion of a reverse inclination surface formed in one section, on an axial projection of the cam, may overlap a contact surface formed on the other section.

The at least one hinge part may include: a left hinge part connecting a left side of the lid to the main body; and a right hinge part connected a right side of the lid to the main body, and the left hinge part and the right hinge part may be symmetrically disposed on the lid.

The left hinge part and the right hinge part may be identical to each other.

The left hinge part and the right hinge part may provide the same damping force.

The pair of cams may include: a fixing cam independently of pivoting of the lid; and a rotary cam rotating in linkage with the lid, and the rotary cam may move in a straight-line direction due to an interaction between a contact surface of the fixing cam and a contact surface of the rotary cam.

The laundry treatment machine may further include a piston that is moved by the rotary cam to deform the elastic member.

The piston may be disposed between the rotary cam and the elastic member inside the hinge housing.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treatment machine comprising:

a main body having an opening for loading laundry;

a lid provided over the opening to open and close the opening; and at least one hinge that supports the lid with respect to the main body, the hinge including a hinge housing filled with a fluid having a prescribed viscosity, a shaft that extends from the hinge housing and coupled to the lid, an elastic member disposed inside the hinge housing; and a cam coupled between the shaft and the elastic member and configured to transform a linear force of the elastic member to a rotational force to the lid, wherein the cam includes at least three engagement protrusions arranged around a circumferential direction of the cam, the engagement protrusions having prescribed shapes that protrude along a rotational axis at a prescribed angle, when the cam rotates based on a movement of the lid, a plurality of contact surfaces on the engagement protrusions slides against corresponding contact surfaces on a follower to change a distance between the cam and the follower, and wherein the laundry treatment machine further includes a piston that is moved by the follower to deform the elastic member, the piston being disposed between the follower and the elastic member inside the hinge housing.

2. The laundry treatment machine of claim 1, wherein the engagement protrusions are provided adjacent to each other such that they protrude at the prescribed angle to spatially overlap at least a portion of an adjacent engagement protrusion in an axial direction.

3. The laundry treatment machine of claim 1, wherein the piston divides an inside of the hinge housing into a first space in which the elastic member is disposed and a second space in which the cam and the follower are disposed.

4. The laundry treatment machine of claim 3, wherein a fluid passage is formed in the piston such that the fluid moves between the first and second spaces.

5. The laundry treatment machine of claim 4, wherein the fluid passage includes a first hole opened toward the first space and a second hole opened toward the second space, wherein a first sectional area of the first hole is smaller than a second sectional area of the second hole.

6. The laundry treatment machine of claim 5, wherein the fluid passage is formed to have an increasingly larger inner diameter from the first hole to the second hole.

7. The laundry treatment machine of claim 1, further including an O-ring between an outer circumferential surface of the piston and an inner circumferential surface of the hinge housing.

8. The laundry treatment machine of claim 1, wherein the contact surface of at least one of the engagement protrusions extends about 120° in the circumferential direction.

9. The laundry treatment machine of claim 1, further including a stopper that restricts a rotation of the lid such that a maximum angle in which the lid opens is less than about 120°.

10. The laundry treatment machine of claim 9, wherein the maximum angle in which the lid opens is substantially 110°.

11. The laundry treatment machine of claim 1, wherein the follower includes a recess corresponding to a protrusion on the cam.

12. The laundry treatment machine of claim 11 wherein the protrusion is provided to extend along a rotational axis of the cam.

13. The laundry treatment machine of claim 11, wherein the protrusion has a prescribed length such that a protrusion is engaged with the recess throughout movement of the cam relative to the follower.

14. The laundry treatment machine of claim 1, wherein the contact surface of each engagement protrusion includes a first contact surface and a second contact surface adjacent the first contact surface, the first contact surface being inclined relative to a rotational axis and the second contact surface being declined relative to the rotational axis.

15. The laundry treatment machine of claim 14, wherein the first contact surface is engaged with a corresponding contact surface of the follower such that a torque is exerted when the lid is opened.

16. The laundry treatment machine of claim 14, wherein the second contact surface is engaged with a corresponding contact surface of the follower such that a torque is exerted when the lid is closed.

17. The laundry treatment machine of claim 16, wherein, when the lid is in a closed position, the second contact surface is engaged with a corresponding contact surface of the follower.

18. The laundry treatment machine of claim 1, wherein the at least one hinge includes a left hinge that couples a left side of the lid to the main body; and a right hinge that couples a right side of the lid to the main body, the left hinge and the right hinge being symmetrically disposed on the lid.

19. The laundry treatment machine of claim 18, wherein the left hinge and the right hinge are identical to each other and provide the same damping force.

* * * * *